United States Patent [19]

Gratacap

[11] 3,964,043

[45] June 15, 1976

[54] ELECTRONIC ALARM BOLT

[75] Inventor: Georges R. Gratacap, Cannes, France

[73] Assignee: Seymour Gillman, New York, N.Y.

[22] Filed: Aug. 16, 1974

[21] Appl. No.: 498,180

[30] Foreign Application Priority Data

Sept. 14, 1973 France ..... 73.34417

[52] U.S. Cl. ..... 340/274 R; 340/256; 340/274 C

[51] Int. Cl.[2] ..... G08B 13/08

[58] Field of Search ..... 340/274 R, 274 C, 283, 340/256

[56] References Cited

UNITED STATES PATENTS

| | | | |
|---|---|---|---|
| 1,573,802 | 2/1926 | Cadenel | 340/274 C |
| 3,513,466 | 5/1970 | Isaacs et al. | 340/274 C |
| 3,609,739 | 9/1971 | Walter | 340/274 |
| 3,623,087 | 11/1971 | Gallichotte et al. | 340/285 |
| 3,781,861 | 12/1973 | Adler, Jr. et al. | 340/256 |
| 3,851,326 | 11/1974 | Costa | 340/283 |

*Primary Examiner*—Glen R. Swann, III

[57] ABSTRACT

A self contained alarm device has within a housing a first and second switching means wherein when a circuit is opened across a pair of control terminals the first switching means energizes the second switching means which then becomes independent of the state of the first switching means or the circuit across the control terminals. When the second switching means is energized it operates an alarm means until the former is purposely reset by means of a thermally operated switching device. In addition the alarm device can be selectively defeated by choosing a particular position of a multiposition switch to insure that a closed circuit exists across the control terminals.

8 Claims, 6 Drawing Figures

ELECTRONIC ALARM BOLT

BACKGROUND OF THE INVENTION

This invention pertains to a burglar alarm and more particularly to such alarms which are self-contained and can be selectively defeated. Such alarms can be classified according to the method employed to detect the burglar or intruder. In the first class are passive devices which are energized by the closing of one or more control circuits. However, the devices of this class can be defeated by cutting or opening the control circuits. Another class is generally the wireless type which uses acoustic standing waves, electromagnetic fields or photoelectric techniques. Devices of this class are usually complex, expensive, cumbersome and require considerable electric power. A third class relies on the opening of a normally closed control circuit to activate the alarm. Conventional devices of the third class commonly use a relay as a means for detecting an opening of the control circuit. When the control circuit is open the relay "drops out" to energize an alarm circuit. However, relays and even very sensitive relays require considerable continuous current. Hence, they are powered by house current or by batteries which must be frequently changed or recharged.

In addition with many alarm systems it is often necessary for the owner to enter the area guarded by the alarm device without triggering it. Therefore, such alarms should include confidential or coded defeating mechanisms.

SUMMARY OF THE INVENTION

It is accordingly a general object of the invention to provide an alarm device which while being of the class which gives an alarm when a control circuit is opened, requires a minimal drain of electrical energy. It is another object of the invention to provide such an alarm device which is self-contained and is readily attachable to a door, window or the like.

It is a further object of the invention to provide with such an alarm device a simple means for controllably defeating the operation of the device when necessary. Other objects, the features and advantages of the invention will be apparent from the following detailed description when read with the accompanying drawing which shows the presently preferred embodiment of the invention.

DETAILED DESCRIPTION OF THE INVENTION

Figure 1:
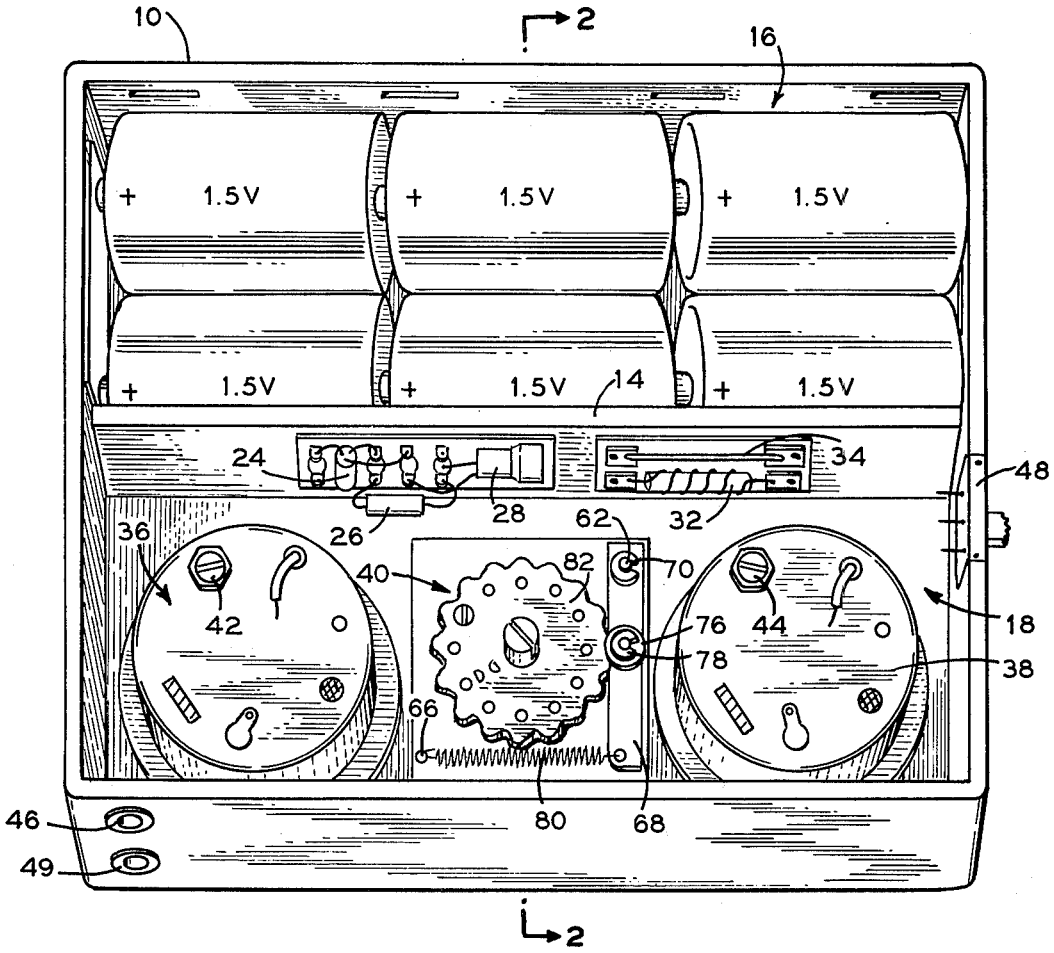
FIG. 1 shows a perspective view of the alarm device according to the invention.
Figure 2:
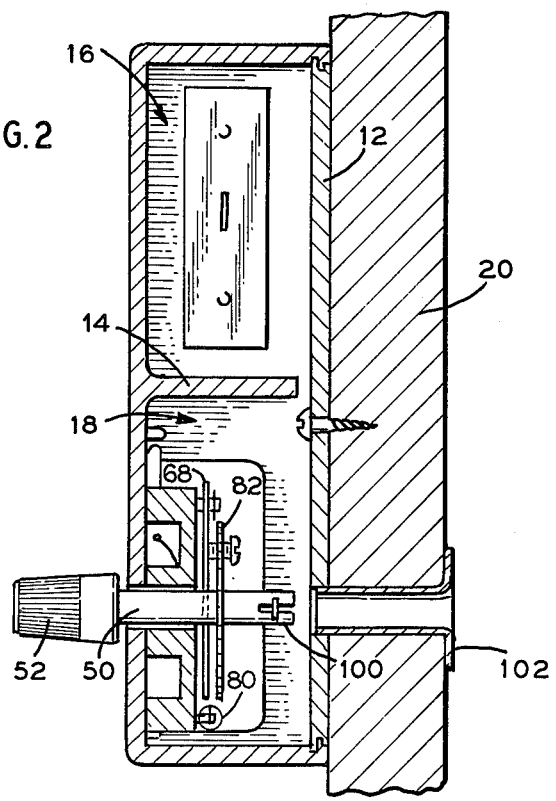
FIG. 2 is a sectional view of the alarm device taken along lines 2—2 of FIG. 1 when the device is fixed to a door.

In FIG. 1 the alarm device is shown contained in rectangular box 10 with its cover 12 as shown in FIG. 2 removed. The box is divided by component wall 14 into a battery chamber 16 and a component chamber 18.

Figure 5:
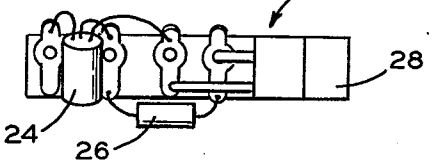
FIGS. 5 and 6 are perspective views of several of the components of the electrical circuitry of the alarm device.
Figure 6:
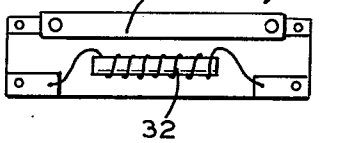

With the cover 12 of FIG. 2 in place, the box 10 can be mounted on a door or wall 20 as shown in FIG. 2. Upon the component wall 14 there is mounted as shown in FIG. 5, a switching subassembly 22 which includes a transistor 24, a resistor 26 and thyristor 28, and as shown in FIG. 6 a thermal control subassembly 30 which includes a wirewound heating resistor 32 and a bimetallic switch 34. Within the component chamber 18 are two vibrator-type buzzers 36 and 38 and a multiposition selector switch 40. The buzzers 36 and 38 are provided with adjusting screws 42 and 44 respectively, to control and select the pitch of the buzzers. Within the battery chamber 16 two sets of three 1.5 V cells in series are connected in parallel.

Passing through an outer wall of box 10 are a female recepticle 46 constituting a pair of control terminals, a female recepticle constituting a bypass switch 49, an on-off switch 48, and as shown in FIG. 2, the shaft 50 and knob 52 of the selector switch 40 as shown in FIG. 1.

Figure 4:
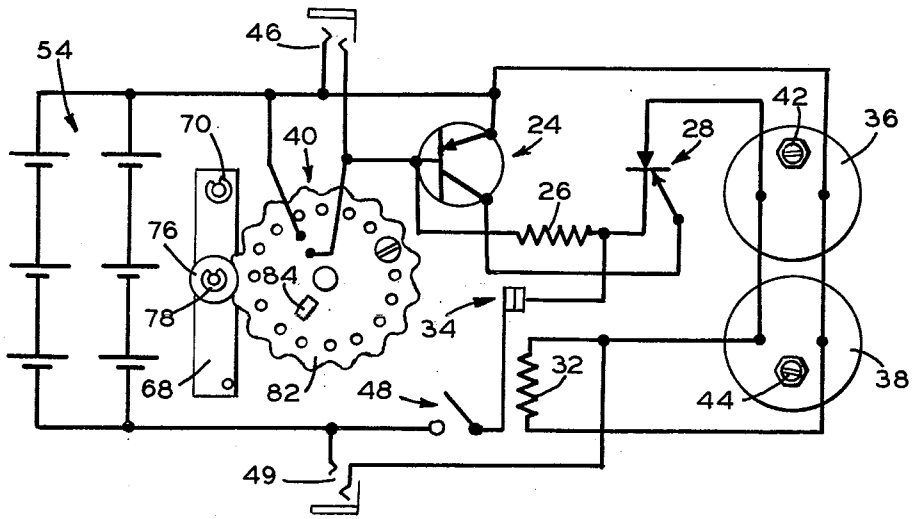
FIG. 4 is a schematic diagram of the electrical circuitry of the alarm device.

The female recepticle 46 constituting a pair of control terminals as shown in FIG. 4, is connected to a detector (not shown) which is in effect a normally closed switch such as a microswitch having a mechanical follower resting against a door or window which is to be protected. As long as the door or window is closed there is a short circuit across the terminal of the female recepticle 46.

Accordingly, assuming on-off switch 48 of FIG. 4 is closed, the emitter terminal of PNP transistor 24 is shorted to the base terminal thereof rendering the transistor cut off or non-conducting. Therefore, assuming thyristor 28 was previously cut off, it will at this time still be cut off. When the door opens or anything occurs such as a deliberate cutting of control wires from the Microswitch to the control terminals 46, the short circuit between the base and emitter terminals of the transistor opens. Since the emitter terminal is connected to the positive terminal of operating voltage power 54 (the batteries) and the base terminal via resistor 26 and switches 34 and 48 to the negative terminal of power source 54, transistor 24 conducts and sends a trigger pulse to the gate terminal of thyristor 28. Since the cathode terminal of the thyristor 28 is connected, via switches 34 and 48 to the negative terminal of power source 54, and the anode terminal is connected, via the parallel combination of resistor 32 and buzzers 36 and 38 to the positive terminal of power source 54, thyristor 28 "fires" and starts conducting causing the buzzers 36 and 38 to vibrate and emit an audible alarm. Note that once the thyristor 28 is triggered on by transistor 24, terminals 46 lose all control over the thyristor 28 which must be cut off by other means. The cutting off is performed by heating resistor 32 in combination with bimetallic switch 34. Note that once the thyristor 28 starts conducting, current flows through resistor 32 which starts heating and influencing switch 34 which when it has reached a certain temperature after a given period of time opens and disconnects the anode of thyristor 28 from the negative terminal of power source 54. Thereafter, even if when the switch 34 again closes, thyristor 28 will not fire until it receives a signal from transistor 24 at its gate terminal.

There are several variations to the circuits. For example, the alarm can be shut off completely by opening on-off switch 48. This would be the case if the alarm device is monitoring a window which is to be purposely and lawfully opened. In addition, the usefulness of the power source 54 can be checked without relying on the electronics merely by shorting the contacts of switch 49, or the operation of the buzzers 36 and 38 can be made dependent on the state of a circuit connected across switch 49.

However the most important variation is performed by the multiposition selector switch 40 which is used to defeat the alarm when the device is mounted and operable. In effect, switch 40 is wired in parallel with the terminals of female receptacle 46.

One of the sixteen positions of switch 40 will present a short circuit across the control terminals of 46, then, the door can be opened without triggering the buzzers 36 and 38. Thus, in effect, one can defeat the alarm without making such defeating known to strangers.

Figure 3:
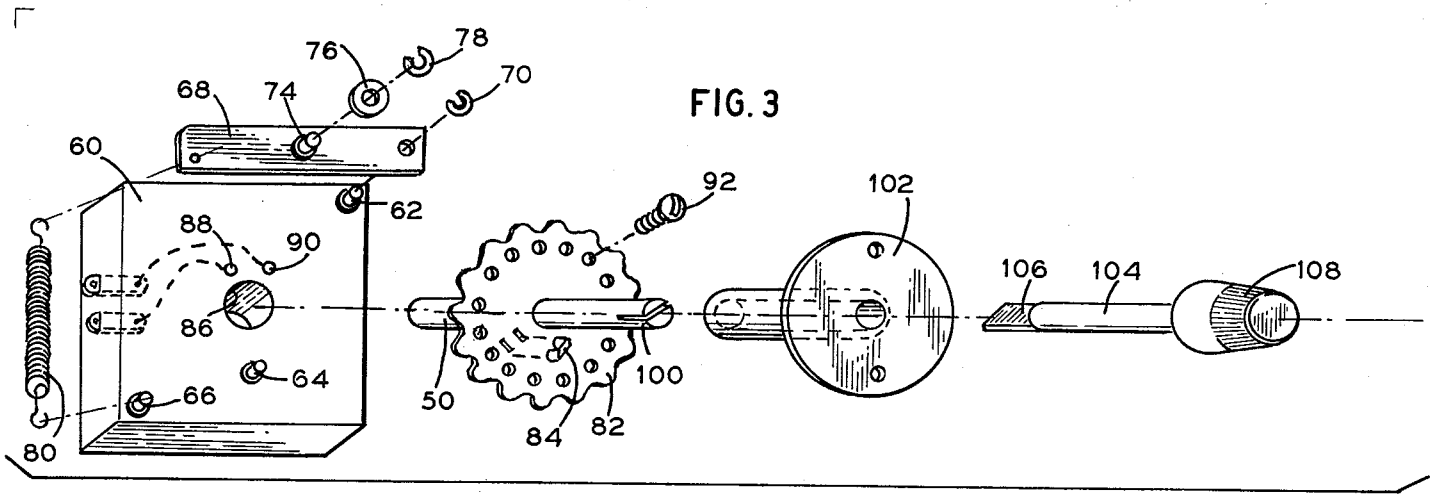
FIG. 3 is an exploded view of a multiposition selector switch in the alarm device of FIG. 1.

The switch 40 is best shown in the exploded view of FIG. 3 and the assembled view in FIG. 1 and comprises a mounting 60 of plastic which has an upwardly extending axle 62, abutment 64 and stud 66. Pivotably mounted on axle 62 is a plate 68 which is held on the axle 62 by C-washer 70. Standing up from plate 68 is an axle 74 which carries a shim 76 held thereon by C-washer 78. A spring 80 extends between stud 66 and a hole in plate 68 to urge the plate carrying shim 76 against notched wheel 82.

Notched wheel 82 is mounted on shaft 50 which is held by bearing 86 within plastic mounting 60. Notched wheel 82 carries a commutator 84 which can rotate in a circle and in one position bridges the contact points 88 and 90 connected to control terminals 46. When wheel 82 is in the correct rotary position, commutator 84 shorts contacts 88 and 90. There are sixteen notches in the wheel 82 and each of these notches is mechanically engaged by shim 76 when the wheel is rotated. Associated with each notch is a hole which can accept a screw 92. The number of notches counting from abutment 64 constitutes a defeating combination or code to position the commutator 84 for shorting the contacts 88 and 90.

If the alarm device is to be used on a door it will be necessary to provide access to switch 40 not only from the area being protected (the inside side of the door) as is accomplished by shaft 50 and knob 52 of FIG. 2, but also from the outside of the door or the unprotected area. This is accomplished as shown in FIG. 2 by putting a slot 100 at the end of shaft 50, cutting a hole in the door and inserting flanged tube 102 in the door. In addition, a user is provided as shown in FIG. 3 with a key in the form of shaft 104 having a blade 106 at one end and a knob 108 at the other. A user from the outside merely inserts shaft 104 in tube 102 until blade 106 enters the slot 100 at the end of shaft 50. The user then rotates the shaft the desired known amount to align the commutator 84 until contacts 88 and 90 are shorted out.

What is claimed is:

1. A self-contained electrically operated device for operation when a normally closed control circuit external to the device is opened comprising: first and second control terminals across which the control circuit is connected; a source of an operating voltage having first and second output terminals; a first switching means energized by said source of operating voltage and connected across said first and second control terminals for assuming a first operating state as long as a closed circuit exclusive of said first switching means exists across said first and second control terminals and for switching to a second operating state when said closed circuit does not exist; a second switching means energized by said source of operating voltage and having a trigger input means connected to said first switching means, a resetting means, and an output means, said second switching means for being triggered to a first operating state the first time said first switching means assumes its second operating state and remaining in said first operating state until the operating of said resetting means; an alarm means connected to the output means of said second switching means for giving an alarm as long as said second switching means is in its first operating state; and manually operable multiple position switching means for controllably connecting a closed circuit across said first and second control terminals when in a particular selected position.

2. The alarm device of claim 1 wherein said first switching means comprises a transistor having an emitter terminal connected to said first output terminal of said source of operating voltage, a base terminal connected to said first control terminal and a collector terminal connected to the trigger input of said second switching means, and further comprising means for connecting said second control terminal to said first output terminal of said source of operating voltage.

3. The alarm device of claim 1 wherein said second switching means comprises a thyristor having a gate terminal which is said trigger input, an anode terminal which is said output means, and a cathode terminal, means for connecting said alarm means between said anode terminal and said first terminal of said source of operating voltage, and means for connecting said cathode terminal via said resetting means to said second terminal of said source of operating voltage.

4. The alarm device of claim 3 further comprising a heat generating resistor connected in parallel with said alarm means, and wherein said resetting means comprises a thermally operated switch operatively adjacent and responsive to said heat generating resistor.

5. The alarm device of claim 4 wherein said first switching means comprises a transistor having an emitter terminal connected to said first output terminal of said source of operating voltage, a base terminal connected to said first control terminal and a collector terminal connected to the trigger input of said second switching means, and further comprising means for connecting said second control terminal to said first output terminal of said source of operating voltage.

6. The alarm device of claim 5 wherein said manually operable multiposition switching means is a multiple position rotary switch arranged such that in one of its positions said first and second control terminals are interconnected, and means for controllably changing which of the positions performs such interconnection.

7. The alarm device of claim 1 wherein said source of operating voltage is a battery.

8. The alarm device of claim 1 further comprising a housing for containing all of said switching means, said source of operating voltage and said alarm means, said housing being provided with access to said first and second control terminals and to said manually operable multiposition switching means.

* * * * *